US006027273A

United States Patent [19]

Li

[11] Patent Number: 6,027,273

[45] Date of Patent: Feb. 22, 2000

[54] TOOTHBRUSH WITH PRESSURIZED TOOTHPASTE DISPENSER

[76] Inventor: Yu Cheng Li, 707 S. 5th Ave., Arcadia, Calif. 91006

[21] Appl. No.: 09/176,832

[22] Filed: Oct. 22, 1998

[51] Int. Cl.[7] ..... A46B 5/02

[52] U.S. Cl. ..... 401/190; 401/46; 401/47; 401/180; 401/134

[58] Field of Search ..... 401/46, 47, 180, 401/190, 134, 135

[56] References Cited

U.S. PATENT DOCUMENTS

| | | | |
|---|---|---|---|
| 2,303,667 | 12/1942 | Taborski | 401/47 |
| 2,790,190 | 4/1957 | Mastrandrea | 401/46 |
| 3,056,151 | 10/1962 | Vlacancich | 401/135 X |
| 3,094,130 | 6/1963 | Wiener | 401/190 |
| 3,593,707 | 7/1971 | Pifer | 401/46 |
| 4,717,278 | 1/1988 | Kemeny | 401/190 X |
| 5,407,287 | 4/1995 | Braun et al. | 401/190 X |

FOREIGN PATENT DOCUMENTS

| | | | |
|---|---|---|---|
| 613399 | 5/1935 | Germany | 401/175 |
| 2643827 | 3/1978 | Germany | 401/180 |

*Primary Examiner*—David J. Walczak

[57] ABSTRACT

A toothbrush with pressurized toothpaste dispenser for dispensing toothpaste by pressing a release valve. The inventive device includes a toothbrush having a handle portion and a brushing portion. The handle portion has a hollow interior with a paste conduit extending from it into the brushing portion. The paste conduit is in communication with a paste nozzle that extends outwardly of the brushing portion. The brushing portion has a plurality of bristles that extend outwardly from it and surround the paste nozzle. The hollow interior of the handle portion of the toothbrush is adapted to receive toothpaste. The interior has a forward biasing portion that urges toothpaste held in the hollow interior of the handle portion into the paste conduit. A paste dispensing valve is in communication with the paste conduit.

2 Claims, 2 Drawing Sheets

TOOTHBRUSH WITH PRESSURIZED TOOTHPASTE DISPENSER

BACKGROUND OF THE INVENTION

1. Field of the Invention

The present invention relates to combination toothbrushes and toothpaste dispensers and more particularly pertains to a new toothbrush with pressurized toothpaste dispenser for dispensing toothpaste by pressing a single release valve.

2. Description of the Prior Art

The use of combination toothbrushes and toothpaste dispensers is known in the prior art. More specifically, combination toothbrushes and toothpaste dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art combination toothbrushes and toothpaste dispensers include U.S. Pat. No. 4,375,924 to Lemire; U.S. Pat. No. 4,062,635 to Teh-Sheng; U.S. Pat. No. 3,738,761 to Segerstad; U.S. Pat. No. 4,583,563 to Turner; U.S. Pat. No. 5,400,839 to Cravett; and U.S. Pat. No. Des. 364,274 to Vasquez.

While these devices fulfill their respective, particular objectives and requirements, the aforementioned patents do not disclose a new toothbrush with pressurized toothpaste dispenser. The inventive device includes a toothbrush having a handle portion and a brushing portion. The handle portion has a hollow interior with a paste conduit extending from it into the brushing portion. The paste conduit is in communication with a paste nozzle that extends outwardly of the brushing portion. The brushing portion has a plurality of bristles that extend outwardly from it and surround the paste nozzle. The hollow interior of the handle portion of the toothbrush is adapted to receive toothpaste. The interior has a forward biasing portion that urges toothpaste held in the hollow interior of the handle portion into the paste conduit. A paste dispensing valve is in communication with the paste conduit.

In these respects, the toothbrush with pressurized toothpaste dispenser according to the present invention substantially departs from the conventional concepts and designs of the prior art, and in so doing provides an apparatus primarily developed for the purpose of dispensing toothpaste by pressing a single release valve.

SUMMARY OF THE INVENTION

In view of the foregoing disadvantages inherent in the known types of combination toothbrushes and toothpaste dispensers now present in the prior art, the present invention provides a new toothbrush with pressurized toothpaste dispenser construction wherein the same can be utilized for dispensing toothpaste by pressing a single release valve.

The general purpose of the present invention, which will be described subsequently in greater detail, is to provide a new toothbrush with pressurized toothpaste dispenser apparatus and method which has many of the advantages of the combination toothbrushes and toothpaste dispensers mentioned heretofore and many novel features that result in a new toothbrush with pressurized toothpaste dispenser which is not anticipated, rendered obvious, suggested, or even implied by any of the prior art combination toothbrushes and toothpaste dispensers, either alone or in any combination thereof.

To attain this, the present invention generally comprises a toothbrush having a handle portion and a brushing portion. The handle portion has a hollow interior with a paste conduit extending from it into the brushing portion. The paste conduit is in communication with a paste nozzle that extends outwardly of the brushing portion. The brushing portion has a plurality of bristles that extend outwardly from it and surround the paste nozzle. The hollow interior of the handle portion of the toothbrush is adapted to receive toothpaste. The interior has a forward biasing portion that urges toothpaste held in the hollow interior of the handle portion into the paste conduit. A paste dispensing valve is disposed within the handle portion of the toothbrush. The dispensing valve is in communication with the conduit. The dispensing valve includes a button slidably disposed within a recess. A lower end of the button is coupled with a spring secured within the recess. The button has an aperture directed therethrough for selectively aligning with the conduit when the button is pressed downwardly against an urging of the spring.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new toothbrush with pressurized toothpaste dispenser apparatus and method which has many of the advantages of the combination toothbrushes and toothpaste dispensers mentioned heretofore and many novel features that result in a new toothbrush with pressurized toothpaste dispenser which is not anticipated, rendered obvious, suggested, or even implied by any of the prior art combination toothbrushes and toothpaste dispensers, either alone or in any combination thereof.

It is another object of the present invention to provide a new toothbrush with pressurized toothpaste dispenser which may be easily and efficiently manufactured and marketed.

It is a further object of the present invention to provide a new toothbrush with pressurized toothpaste dispenser which is of a durable and reliable construction.

An even further object of the present invention is to provide a new toothbrush with pressurized toothpaste dispenser which is susceptible of a low cost of manufacture with regard to both materials and labor, and which accordingly is then susceptible of low prices of sale to the consuming public, thereby making such toothbrush with pressurized toothpaste dispenser economically available to the buying public.

Still yet another object of the present invention is to provide a new toothbrush with pressurized toothpaste dispenser which provides in the apparatuses and methods of the prior art some of the advantages thereof, while simultaneously overcoming some of the disadvantages normally associated therewith.

Still another object of the present invention is to provide a new toothbrush with pressurized toothpaste dispenser for dispensing toothpaste by pressing a single release valve.

Yet another object of the present invention is to provide a new toothbrush with pressurized toothpaste dispenser which includes a toothbrush having a handle portion and a brushing portion. The handle portion has a hollow interior with a paste conduit extending from it into the brushing portion. The paste conduit is in communication with a paste nozzle that extends outwardly of the brushing portion. The brushing portion has a plurality of bristles that extend outwardly from it and surround the paste nozzle. The hollow interior of the handle portion of the toothbrush is adapted to receive toothpaste. The interior has a forward biasing portion that urges toothpaste held in the hollow interior of the handle portion into the paste conduit. A paste dispensing valve is in communication with the paste conduit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
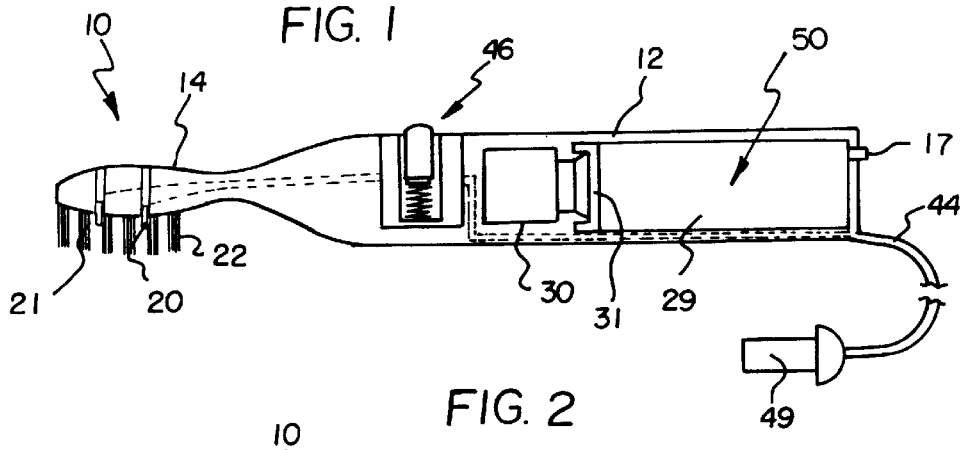
FIG. 1 is a cross sectional view of a new toothbrush with pressurized toothpaste dispenser according to the present invention.
Figure 2:
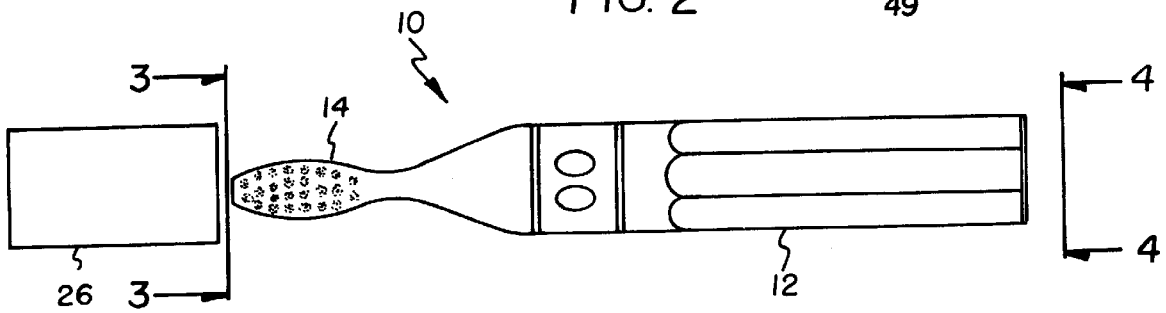
FIG. 2 is a side view of the present invention.
Figure 3:
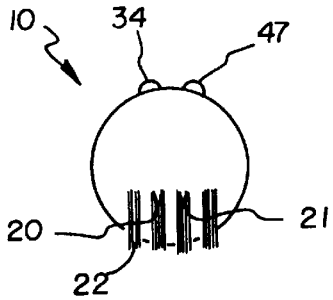
FIG. 3 is a front of the present invention as taken along line 3—3 of FIG. 2.
Figure 4:
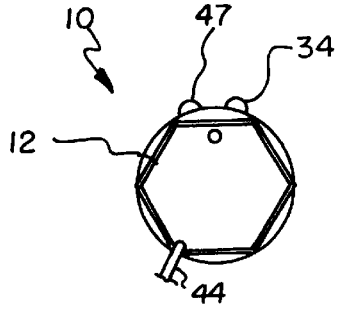
FIG. 4 is a back view of the present invention as taken along line 4—4 of FIG. 2.
Figure 5:
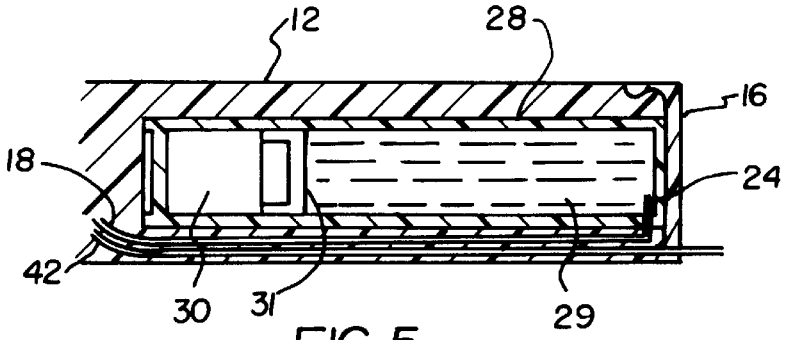
FIG. 5 is a cross-sectional view of the handle portion of the present invention.
Figure 6:
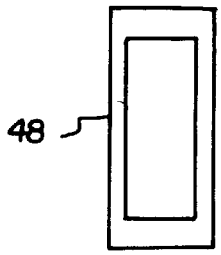
FIG. 6 is a side view of a tap adapter of the invention.
Figure 7:
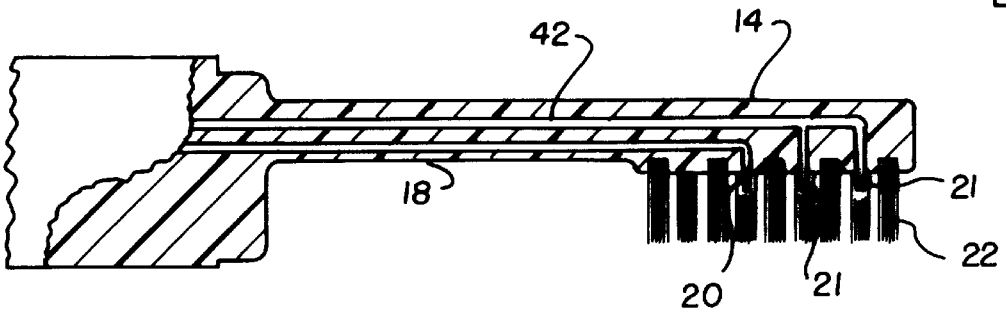
FIG. 7 is a cross-sectional view of the brush portion of the present invention.
Figure 8:
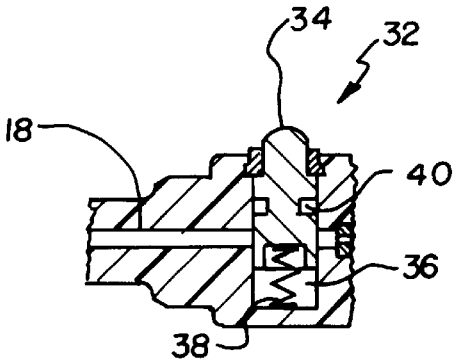
FIG. 8 is a cross-sectional view of the paste dispensing valve in a closed orientation.
Figure 9:
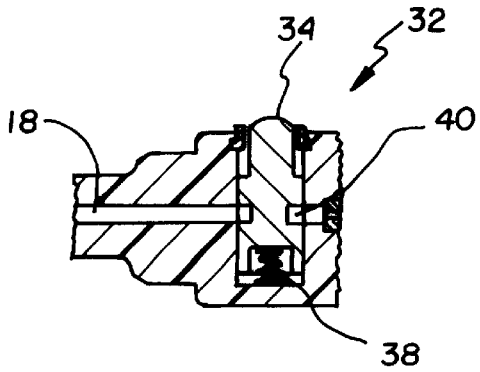
FIG. 9 is a cross-sectional view of the paste dispensing valve in an open orientation.

With reference now to the drawings, and in particular to FIGS. 1 through 9 thereof, a new toothbrush with pressurized toothpaste dispenser embodying the principles and concepts of the present invention and generally designated by the reference numeral 10 will be described.

As best illustrated in FIGS. 1 through 9, the toothbrush with pressurized toothpaste dispenser 10 comprises a toothbrush having a handle portion 12 and a brushing portion 14. The handle portion 12 has a hollow interior with a paste conduit 18 extending from it into the brushing portion 14. The paste conduit 18 is in communication with a paste nozzle 20 that extends outwardly of the brushing portion 14. The brushing portion 14 has a plurality of bristles 22 that extend outwardly from it and surround the paste nozzle 20. The hollow interior of the handle portion 12 of the toothbrush is adapted to receive toothpaste. The interior has a forward biasing portion 30 that urges toothpaste held in the hollow interior of the handle portion 12 into the paste conduit 18. A paste dispensing valve 32 is in communication with the paste conduit 18.

Preferably, a cover member 26 removably couples with the brushing portion 14 of the toothbrush.

Also preferably, the paste dispensing valve 32 is disposed within the handle portion 12 of the toothbrush and includes a button 34 slidably disposed within a recess 36. A lower end of the button 34 is coupled with a spring 38 secured within the recess 36. The button 34 has an aperture 40 directed through it for selectively aligning with the paste conduit 18 when the button 34 is pressed downwardly against an urging of the spring 38.

Preferably, a water conduit 42 extends a length of the toothbrush. The water conduit 42 has a forward end in communication with the plurality of water nozzles 21. The water conduit 42 has an outer end with a length of tubing 44 outwardly from it. The length of tubing 44 couples with a water source. Ideally, a tap adapter 48 is coupled with a water source such as a faucet. The length of tubing 44 has a connector 49 that is removably coupled to the tap adapter 48. Most ideally, the tap adapter 48 is left on the faucet and the connector 49 is coupled to it only when needed. Also ideally, a water dispensing valve 46 is in communication with the water conduit 42. The water dispensing valve 46 has a button 47 slidably disposed within a recess in the handle portion 12 of the toothbrush. A lower end of the button is coupled with a spring secured within the recess. The button has an aperture directed through it for selectively aligning with the water conduit 42 when the button is pressed downwardly against an urging of the spring.

In one embodiment of the invention, a pressurized toothpaste tube 28 is received within the hollow interior of the handle portion 12 of the toothbrush. The toothpaste tube 28 has a rearward toothpaste holding portion 29, a forward biasing portion 30, and a plunger 31 that is disposed between the biasing portion 30 and toothpaste held in the toothpaste holding portion 29. The paste conduit 18 has a piercing tube 24 that extends inwardly of the hollow interior. A rearward end of the toothpaste holding portion 29 is punctured by the piercing tube 24 to permit communication between the paste conduit 18 and the toothpaste holding portion. The biasing portion 30 and plunger 31 urge toothpaste in the toothpaste holding portion 29 rearwardly through the piercing tube 24 into the paste conduit 18 and out through the paste nozzle 20. The handle portion 12 has a removable end cap 16 that exposes the hollow interior of the handle portion 12. Ideally, the forward biasing portion 30 has pressurized gas therein which is restrained by the plunger 31.

In another embodiment of the present invention, the handle portion 12 has an aperture into the interior and a removable refill cap 17 closing the aperture into the interior. The hollow interior of the handle portion 12 of the toothbrush has a rearward toothpaste holding portion 50 that is adapted to receive toothpaste therein, a forward biasing portion 30, and a plunger 31 that is disposed between the biasing portion 30 and toothpaste held in the toothpaste holding portion 50. The biasing portion 30 and plunger 31 urge toothpaste in the toothpaste holding portion 50 rearwardly through the piercing tube 24 into the paste conduit 18 and out through the paste nozzle 20 into the bristles 22. The aperture into the interior of the handle portion 12 permits refilling of the toothpaste holding portion 50 with toothpaste. Ideally, the forward biasing portion 30 has a spring therein to maintain constant biasing despite frequent refilling.

In both embodiments, the biasing portion 30 is positioned forwardly to keep the weight of the toothpaste toward the user's hands, thereby providing greater balance and requiring less torque as the user moves the brushing portion of the toothbrush up and down.

Also ideally, the handle portion 12 has a generally polygonal shape. The interior of the handle portion 12 has a generally polygonal shape. The plunger 31 has a generally polygonal shape that substantially corresponds to the shape of the interior of the handle portion 12 to help prevent the plunger 31 from becoming misaligned in the interior as it slides along the interior.

In use, toothpaste would rest within the hollow interior of the handle portion 12 and is propelled to the brushing portion 14. The paste would emit through one or more paste nozzles 20 into the bristles 22 when the button 34 of the paste dispensing valve 32 is pushed. The water would emit through one or more water nozzles 21 into the user's mouth to loosen debris from the teeth and rinse the teeth when the button 47 of the water dispensing valve 46 is pushed. When the supply of toothpaste has been used, a substitute tube or more toothpaste could be inserted into the hollow interior.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothbrush with pressurized toothpaste dispenser for dispensing toothpaste by pressing a release valve comprising, in combination:

a toothbrush having a handle portion and a brushing portion, the handle portion having a removable end cap exposing a hollow interior, the hollow interior having a paste conduit extending therefrom into the brushing portion, the paste conduit being in communication with a paste nozzle extending outwardly of the brushing portion, the brushing portion having a plurality of bristles extending outwardly therefrom, the plurality of bristles surrounding the paste nozzle, the paste conduit having a piercing tube extending inwardly of the hollow interior at a rearward end of the hollow interior, the paste conduit extending from a rearward end of the handle portion to the brushing portion;

a pressurized toothpaste tube received within the hollow interior of the handle portion of the toothbrush, the toothpaste tube having a rearward toothpaste holding portion being adapted for receiving toothpaste therein, a forward biasing portion, and a plunger being disposed between the biasing portion and toothpaste held in the toothpaste holding portion, a rearward end of the toothpaste holding portion being punctured by the piercing tube, wherein the biasing portion and plunger urge toothpaste in the toothpaste holding portion rearwardly through the piercing tube into the paste conduit and out through the paste nozzle into the bristles, wherein the biasing portion comprises a container of pressurized gas located in the interior of the handle portion of the toothbrush, the container being positioned at a medical location of the toothbrush and exerting rearward pressure against the plunger which acts against the toothpaste tube;

a paste dispensing valve disposed within the handle portion of the toothbrush and being in communication with the paste conduit, the paste dispensing valve including a button slidably disposed within a recess, a lower end of the button being coupled with a spring secured within the recess, the button having an aperture directed therethrough for selectively aligning with the conduit when the button is pressed downwardly against an urging of the spring;

a cover member removably coupling with the brushing portion of the toothbrush;

a water conduit extending a length of the toothbrush, the water conduit having a forward end in communication with a plurality of water nozzles, the water conduit having a rearward end having a length of tubing extending outwardly therefrom;

a tap adapter for coupling with a water source;

the length of tubing having a connector being removably coupled to said tap adapter; and a water dispensing valve disposed within the handle portion of the toothbrush alongside the paste dispensing valve and being in communication with the water conduit, the water dispensing valve including a button slidably disposed within a recess, a lower end of the button being coupled with a spring secured within the recess, the button having an aperture directed therethrough for selectively aligning with the water conduit when the button is pressed downwardly against an urging of the spring;

wherein the water conduit has two water nozzles at a head of the brushing portion and the paste conduit has one paste nozzle at the head of the brushing portion.

2. The toothbrush with pressurized toothpaste dispenser of claim 1 wherein the handle portion has a generally polygonal shape, the interior of the handle portion having a generally polygonal shape, the plunger having a generally polygonal shape substantially corresponding to the shape of the interior of the handle portion for helping prevent the plunger from becoming misaligned in the interior.

* * * * *